US011322315B2

(12) United States Patent
Yang et al.

(10) Patent No.: US 11,322,315 B2
(45) Date of Patent: May 3, 2022

(54) CONTROL DEVICE CAPABLE OF PROVIDING ROTATIONAL DAMPING THROUGH ELASTIC FORCE

(71) Applicants: DONGGUAN SOLIDTEK ELECTRONICS CO., LTD., Dongguan (CN); SOLID YEAR CO., LTD., New Taipei (TW)

(72) Inventors: Tien-Hao Yang, New Taipei (TW); Chi-Feng Liu, New Taipei (TW); Yuan-Zhang Liu, Dongguan (CN)

(73) Assignee: SOLID YEAR CO., LTD., New Taipei (TW)

( * ) Notice: Subject to any disclaimer, the term of this patent is extended or adjusted under 35 U.S.C. 154(b) by 0 days.

(21) Appl. No.: 17/035,245

(22) Filed: Sep. 28, 2020

(65) Prior Publication Data

US 2021/0193403 A1 Jun. 24, 2021

(30) Foreign Application Priority Data

Dec. 18, 2019 (TW) ..... 108216803

(51) Int. Cl.
*H01H 3/60* (2006.01)

(52) U.S. Cl.
CPC ..... *H01H 3/60* (2013.01)

(58) Field of Classification Search
CPC .... H01H 3/60; H01H 3/166; H01H 2003/167; H01H 25/041; H01H 2025/048; H01H 2025/043
USPC ..... 200/33 R, 5 A, 6 R, 6 A, 339, 5 R, 4, 200/17 R, 18, 14, 329, 336
See application file for complete search history.

(56) References Cited

U.S. PATENT DOCUMENTS 5,384,442 A * 1/1995 Danner ..... G05G 1/087 200/336
7,446,269 B2 * 11/2008 Stringos ..... H01H 3/166 200/16 B
8,203,087 B2 * 6/2012 Hu ..... H01H 25/041 200/6 R
9,053,877 B2 * 6/2015 Young ..... H01H 13/14
2013/0139621 A1 * 6/2013 Nishikawa ..... F16H 25/125 74/56
2015/0303009 A1 * 10/2015 Seo ..... H01H 25/06 200/4

* cited by examiner

*Primary Examiner* — Edwin A. Leon
(74) *Attorney, Agent, or Firm* — Muncy, Geissler, Olds & Lowe, P.C.

(57) ABSTRACT

A control device capable of providing rotational damping through an elastic force is provided directly at the base of an electronic product and includes an adjusting member and an elastic member. The adjusting member is rotatably provided at the base. The adjusting member has a bottom portion corresponding to a switch provided in the base. The adjusting member further has a head portion outside the base. The elastic member is provided between the adjusting member and the base. The elastic force of the elastic member acts between the head portion of the adjusting member and the base to change the rotational damping to which the adjusting member is subjected.

1 Claim, 1 Drawing Sheet

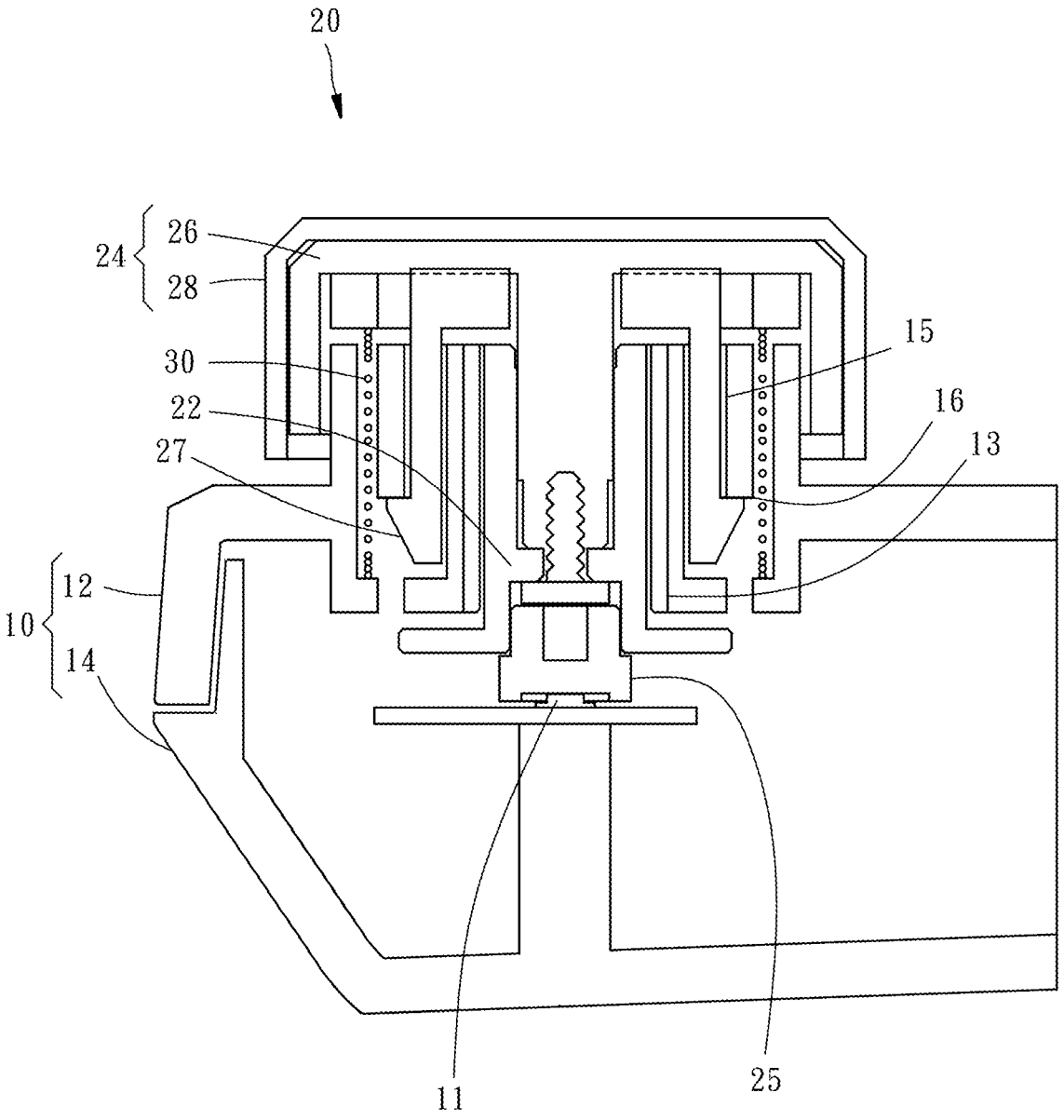
20
24
26
28
30
22
27
15
16
13
12
10
14
11
25

CONTROL DEVICE CAPABLE OF PROVIDING ROTATIONAL DAMPING THROUGH ELASTIC FORCE

BACKGROUND OF THE INVENTION

1. Field of the Invention

The present invention relates to a control device for an electrical switch. More particularly, the invention relates to a control device that provides rotational damping by way of an elastic force.

2. Description of the Related Art

A switch in an electric circuit is an electrical device that can be used to close the circuit, stop an electric current, or guide the electric current to another circuit. A typical switch includes two contacts that can be brought into contact with and separated from each other repeatedly. When the contacts are in contact, the circuit where the switch is used is closed to allow an electric current to flow through the circuit; when the contacts are not in contact, the circuit is open, so no electric current can flow through the circuit. The switch, therefore, serves to control the circuit.

To control and adjust circuit signals more precisely, a switch can be added with a control device that provides rotational damping so that fine-tunable and variable control over the switch can be achieved by operating and adjusting the control device.

However, as the control device capable of providing rotational damping is generally integrated into the switch, mounting the switch on the housing or other component of a mechanism may present problems: tolerance stack-up between the circuit board of the switch and the mechanism may lead to positional deviation or misalignment during assembly such that extra working hours are required for putting the aforesaid components together, which makes it impossible to lower production cost or better the quality of the manufacturing process and of the finished product.

SUMMARY OF THE INVENTION

The primary objective of the present invention is to offer a control device that provides elastic force-based rotational damping, thereby preventing assembly problems associated with positional deviation, reducing the time and cost of manufacture, and enhancing the quality of the finished product as well as the manufacturing process.

To achieve the objective stated above, the present invention discloses a control device that provides rotational damping through an elastic force. The control device is provided at a base, and the base is provided therein with a switch. The control device includes an adjusting member and an elastic member. The adjusting member is rotatably provided at the base. The adjusting member has a bottom portion corresponding to the switch. The adjusting member has a head portion outside the base. The elastic member is provided between the adjusting member and the base. The elastic force of the elastic member acts between the head portion of the adjusting member and the base to change the rotational damping to which the adjusting member is subjected when rotated with respect to the base.

Preferably, the adjusting member includes a rotating shaft, and the rotating shaft is rotatably provided in the base.

Preferably, the base has a positioning portion, the rotating shaft is provided in the positioning portion, and the rotating shaft has a bottom portion corresponding to the switch.

Preferably, the head portion of the adjusting member includes a driving member, and the elastic member is provided between the driving member and the base.

Preferably, the base is provided with an engaging portion, the engaging portion has an internal step portion, the adjusting member has a hook portion extending into the engaging portion and coupled with the internal step portion, and the adjusting member can be rotated with respect to the base.

The detailed structure or features provided by the present invention will be described in the detailed description of the subsequent implementation. As a person of ordinary skill in the art would understand, the detailed description and the specific embodiment provided herein serve only to expound the invention and are not intended to limit the scope of the patent protection sought by the applicant.

BRIEF DESCRIPTION OF THE DRAWINGS

The sole FIGURE schematically shows a preferred embodiment of the present invention.

DETAILED DESCRIPTION OF THE INVENTION

The technical contents and features of the present invention are detailed below with reference to a preferred embodiment in conjunction with the accompanying drawings. The invention can be applied to switches and electronic products of various forms and specifications. As a person of ordinary skill in the art would understand, the terminology used in this section of the specification includes superordinate terms, whose application fields are subject to no limitations. For example, a term that is used to specify a material or shape refers to but is not limited to the material or shape specified. The same applies to such positional terms as "provided", "near", "connected to", and "adjacent to". The indefinite article "a" may connote plurality as well as singularity in terms of the quantity of a component. Directional terms such as "upper", "lower", "inner", "outer", "top", and "bottom" make reference to directions in normal use and serve illustrative purposes only; they are not intended to be restrictive of the scope of the invention.

Referring to the sole FIGURE, a control device capable of providing rotational damping through an elastic force according to the present invention is provided at the base 10 of an electronic product by way of example. The base 10 can be divided into an upper cover 12 and a lower cover 14, with a switch 11 provided in the base 10 in advance and located on the lower cover 14. The upper cover 12 is provided with a positioning portion 13 corresponding in position to the switch 11, and the positioning portion 13 in this preferred embodiment is an open hole by way of example. The outer periphery of the positioning portion 13 is provided with an engaging portion 15, and the engaging portion 15 in this preferred embodiment is a groove with an internal step portion 16 by way of example.

The control device includes an adjusting member 20 and an elastic member 30. The adjusting member 20 includes a rotating shaft 22 and a head portion 24. The head portion 24 includes a driving member 26 and a cover 28 covering the driving member 26. The cover 28 may be made of metal or in a way that produces the desired appearance. The rotating shaft 22 extends through the positioning portion 13 of the base 10 such that the adjusting member 20 is provided at the base 10 in a rotatable manner. The rotating shaft 22 has a bottom portion 25 corresponding to the switch 11. The driving member 26 is provided on the top side of the rotating shaft 22. The driving member 26 has a hook portion 27 extending into the engaging portion 15 of the base 10 and coupled with the internal step portion 16. The driving member 26 is configured to drive the rotating shaft 22 into rotation with respect to the base 10.

The elastic member 30 in this preferred embodiment is a compression spring by way of example. The elastic member 30 is provided between the base 10 and the adjusting member 20. More specifically, the elastic member 30 is provided inside the engaging portion 15 of the base 10 and has one end pressing against the base 10 and the other end pressing against the driving member 26. Once mounted on the base 10, the driving member 26 keeps compressing the elastic member 30 such that the elastic member 30 generates an elastic force. The elastic force of the elastic member 30 acts between and pushes against the driving member 26 of the adjusting member 20 and the base 10 and thereby changes the rotational damping between the driving member 26 and the base 10.

As the adjusting member 20 and the elastic member 30 of the control device are directly joined to the base 10, it is feasible to mount the control device on the upper cover 12 in advance, lest the adjusting member 20 of the control device deviate in position or be shifted in place. After that, the upper cover 12 and the lower cover 14 are put together to complete the assembly, allowing the switch 11 to be controlled with the adjusting member 20. Compared with the prior art, the control device can be made in a shorter time, at a lower cost, and with higher finished product quality as well as higher manufacturing process quality. When it is desired to adjust the rotational damping, all that needs to be done is to use an elastic member 30 of a different modulus of elasticity, and the switch 11 can be rendered into a fine-tunable and variable switch just as well. It is also feasible for the adjusting member 20 to be capable of vertical linear displacement with respect to the base 10 in order to press and thereby trigger the switch 11 directly.

What is claimed is:

1. A control device capable of providing rotational damping through an elastic force, wherein the control device is provided at a base, and the base is provided therein with a switch, the control device comprising:

an adjusting member rotatably provided at the base, wherein the adjusting member has a bottom portion corresponding to the switch, and the adjusting member has a head portion outside the base; and an elastic member provided between the adjusting member and the base, wherein the elastic member has the elastic force acting between the head portion of the adjusting member and the base and thereby changing rotational damping to which the adjusting member is subjected when rotated with respect to the base;

wherein the adjusting member comprises a rotating shaft, and the rotating shaft is rotatably provided in the base;

wherein the base has a positioning portion, the rotating shaft is provided in the positioning portion, and the rotating shaft has a bottom portion corresponding to the switch;

wherein the head portion of the adjusting member comprises a driving member, and the elastic member is provided between the driving member and the base;

wherein the base is provided with an engaging portion, the engaging portion has an internal step portion, the adjusting member has a hook portion extending into the engaging portion and coupled with the internal step portion, and the adjusting member is rotatable with respect to the base;

wherein the elastic member surrounds around the engaging portion and the hook portion.

* * * * *